US005634873A

United States Patent [19]

Carlstrom

[11] Patent Number: 5,634,873

[45] Date of Patent: Jun. 3, 1997

[54] HAMSTRING STRETCHING DEVICE AND METHOD

[75] Inventor: Andrew J. Carlstrom, Palo Alto, Calif.

[73] Assignee: Strong River Corporation, Corvallis, Oreg.

[21] Appl. No.: 303,089

[22] Filed: Sep. 8, 1994

[51] Int. Cl.[6] ..... A63B 21/00

[52] U.S. Cl. ..... 482/95; 482/904; 482/23; 482/142

[58] Field of Search ..... 482/904, 142, 482/23, 140, 95; 114/218

[56] References Cited

U.S. PATENT DOCUMENTS

| | | | |
|---|---|---|---|
| 427,314 | 5/1890 | Hanson et al. . | |
| 2,183,265 | 12/1939 | Maloney . | |
| 3,117,782 | 1/1964 | Johnston | 482/142 |
| 3,714,833 | 2/1973 | Newman . | |
| 3,730,129 | 5/1973 | Helms | 114/218 |
| 4,084,815 | 4/1978 | Flannery | 272/119 |
| 4,362,151 | 12/1982 | Cottrell | 128/75 |
| 4,466,599 | 8/1984 | Singer | 254/391 |
| 4,489,936 | 12/1984 | Dal Monte . | |
| 4,509,745 | 4/1985 | Angsten . | |
| 4,574,789 | 3/1986 | Forster . | |
| 5,024,433 | 6/1991 | Mosberg | 482/23 |
| 5,067,709 | 11/1991 | Christianson . | |
| 5,123,131 | 6/1992 | Jandrakovic | 5/81.1 |
| 5,261,865 | 11/1993 | Trainor | 482/95 |
| 5,387,186 | 2/1995 | Edland | 602/36 |

FOREIGN PATENT DOCUMENTS

| | | |
|---|---|---|
| 732485 | 3/1932 | France . |
| 407833 | 2/1966 | Switzerland . |

*Primary Examiner*—Jerome Donnelly

*Attorney, Agent, or Firm*—Flehr Hohbach Test Albritton & Herbert

[57] ABSTRACT

An exercise and stretching device has a line and a combination comprising a support positioned relative to the line to redirect the line from a first direction to a second direction. The line has a first location on one side of the support to secure a first human appendage and a second location on an other side of the support for manipulation by a different human appendage. A grip is positioned relative to the support to hold the line at a selected position relative to the support.

4 Claims, 2 Drawing Sheets

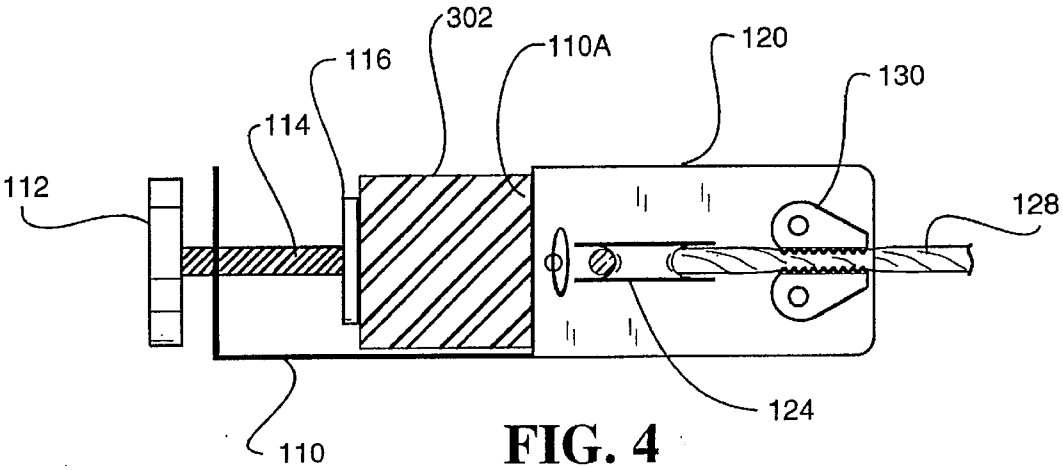
FIG. 4
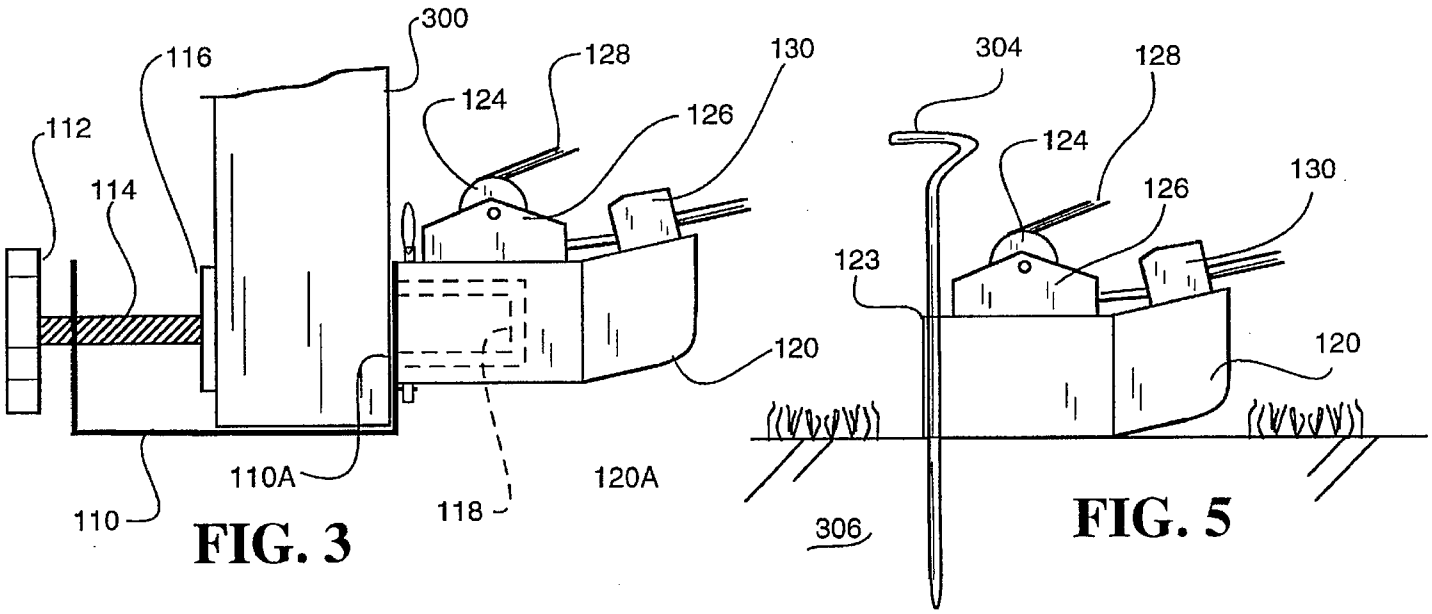
FIG. 5
FIG. 3

HAMSTRING STRETCHING DEVICE AND METHOD

BACKGROUND OF THE INVENTION

The present invention relates to an exercising and stretching apparatus. Specifically, it relates to an apparatus for exercising and stretching one of a person's appendages, such as a leg, using a force exerted by another appendage or appendages, such as arms.

Exercising and stretching are important for increasing a person's flexibility and preventing injury during sporting activities. Moreover, stretching is important for physical therapy such as when a person is recovering from an accident.

Most current stretching equipment is complex. This complexity even extends to relatively simple devices designed to stretch the muscles of an appendage, such as a leg. Such complexity is a result of many factors, one of which is the desire to provide a mechanical advantage, e.g., to the arms in order to stretch the legs. Another is a desire to maintain the person's torso at a fixed position while the appendage such as a leg is leveraged into a stretched position.

Some of such devices include a rope that is securable to a person's foot in order to stretch the leg. The rope is passed through a pulley designed to change the direction of the rope and provide a convenient angle for grasping of the free end by the person's hands in order to pull on the rope and stretch the leg.

A known apparatus employs a plurality of pulleys to gain mechanical advantage and a clutched pulley to permit some relaxation of the exertion force required to leverage the leg into the stretched position. This apparatus also employs a belt to restrain the user's torso during the stretch. An example of a device embodying these features is shown in U.S. Pat. No. 5,067,709.

What is needed is an exercising and stretching device that is easy to configure and simple to use.

SUMMARY OF THE INVENTION

The present invention provides a stretching device that is superior to previous devices. A stretching device has a line and a combination comprising a support positioned relative to the line to redirect the line from a first direction to a second direction. A low-friction mechanism used to redirect the line is a pulley. The line has a first location on one side of the support to secure a first human appendage and a second location on an other side of the support for manipulation by a different human appendage or appendages. Preferably these are a loop to fit over the foot and a handle for the hands. A grip is positioned relative to the support to hold the line at a selected position relative to the support. A cleat permits one-way movement of the line while preventing opposite movement of the line, and the line can be freed from the cleat by moving the line in a direction transverse to the cleat.

The present invention uses a straightforward arrangement of components to permit easy assembly, a high degree of mobility, and temporary attachment to a fixture. Moreover, the present invention provides a grip that permits the user to completely relax the exertive force necessary to stretch a desired appendage and maintain the appendage in the stretched position indefinitely.

BRIEF DESCRIPTION OF THE FIGURES

With reference to the accompanying figures:

FIG. 3 depicts the embodiment attached to a door.

FIG. 4 depicts the embodiment attached to a post.

FIG. 5 depicts the embodiment attached to a stake.

DETAILED DESCRIPTION OF A PREFERRED EMBODIMENT

The following description is provided to satisfy the patent statutes. Those skilled in the art will appreciate that various changes and modifications can be made while remaining within the scope of the present invention.

Figure 1:
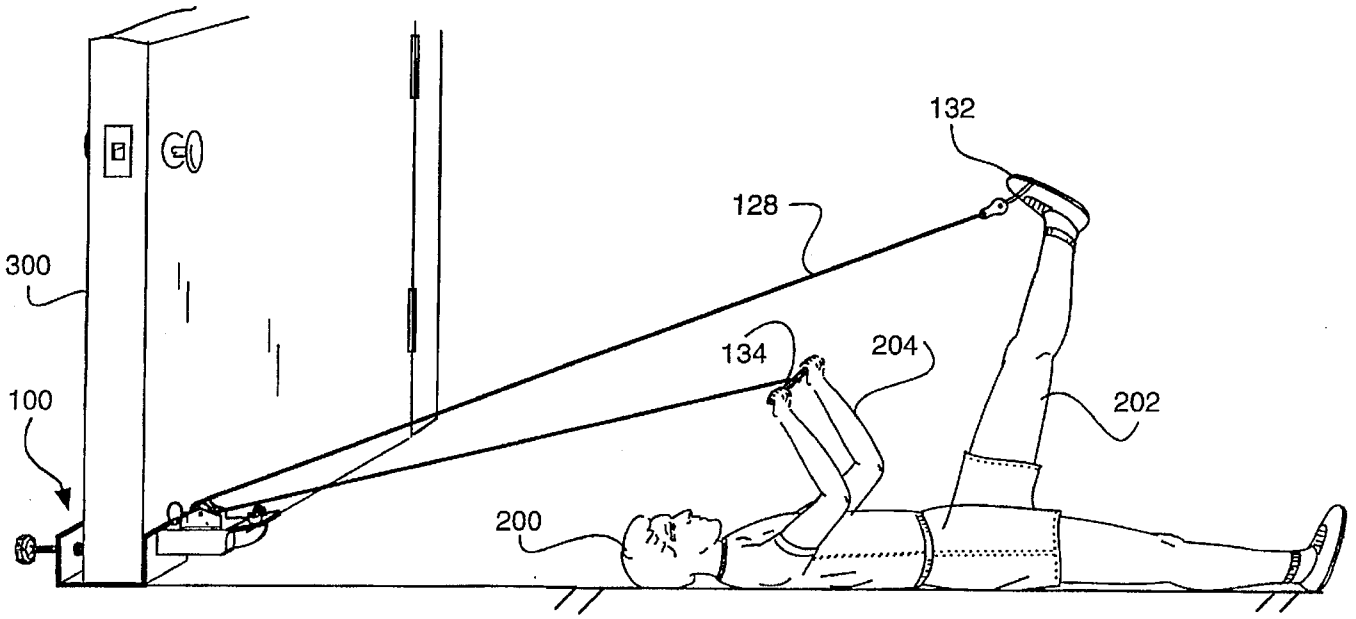
FIG. 1 depicts a person using a device constructed according to the present invention.

An embodiment of the invention is described with reference to FIGS. 1, 2 and 3. An exercise and stretching device 100 is shown being used by a person 200 for stretching his leg. The user 200 first places the stretching device 100 under a horizontal fixture such as a door 300. He clamps the device to the door 300 by placing an anchor bracket 110 under the edge of the door 300 and turning a handle 112. This spins a threaded shaft 114 and moves a plate 116 toward an opposing face **110*a* of the bracket 110 to capture the door edge. When the plate and the face 110*a* come together with the door 300** therebetween, the anchor is clamped to the fixture.

Next, the user lies on the floor with his head near the device 100. A line 128, such as a rope, which is threaded through a pulley 124 that rotates around a pin 125 is attached to the user's foot by a loop 132 and grasped by his hands by a handle 134. The user then pulls on the line 128 with his hands causing his leg to raise upwardly. Raising his legs helps to stretch his hamstring muscles located in the rear of his leg as well as other associated muscles. The line can be retained by a grip 130 that holds the line in place while the leg maintains the stretched position. When the user 200 has completed his stretch, he pulls the line in a direction transverse to the grip 130 to free the line from the grip 130. He can then allow his leg to return to the resting position and control the movement of the leg by the handle 134 that he is grasping with his hands.

Specifically describing the support 120, there is a pulley 124 to redirect a line 128, such as a rope, from one direction to another. The pulley 124 connects to the support by a bracket 126 having a pin 125 for rotatably securing the pulley 124. The pulley 124 is positioned so that when the line 128 is pulled in the direction indicated by the arrow, the line 128 slips into a grip 130. The grip 130, which can be a cleat, permits the line 128 to move through the grip 130 in one direction and not the other. That is, when the line is attached to a first appendage 202, the grip 130 allows the user 200 to manipulate, or pull, the line with a second appendage 204. And, when the line is pulled in this manner, the grip 130 prevents the line from retracting through the pulley 124 in the opposite direction. Thus, the user 200 can release tension on the line 128 held by the appendage 204 while maintaining the appendage 202 in a fixed position. This grip feature is advantageous because it permits a user to maintain the appendage 202 in a stretched position for a long period of time while relaxing the appendage 204 that performed the work to raise the appendage 202.

A cam cleat provides two opposing cams which have a ribbed surface and are spring loaded. The springs permit the line to move through the cams in one direction and do not permit the line to move in the opposite direction. One advantage to using a cam cleat as the grip is that the line does not need to slip into the grip such as with a clam cleat, but rather is already within the grip as the line is pulled by the user.

The location of the support 120 in relation to the user 200 can be helpful in the invention. For example, as shown in FIG. 1, the user is supine and the device 100 is low to the ground. This position permits the user to pull on the line with a handle 134 and raise the appendage attached to the loop 132 while keeping the user's back against the floor. The resulting acute angle between the floor and the line attached to the appendage 202 promotes a downward force vector that serves to keep the user's torso against the ground. This obviates the need to employ a torso restraining belt included as part of the structure shown in U.S. Pat. No. 5,067,709.

Figure 2:
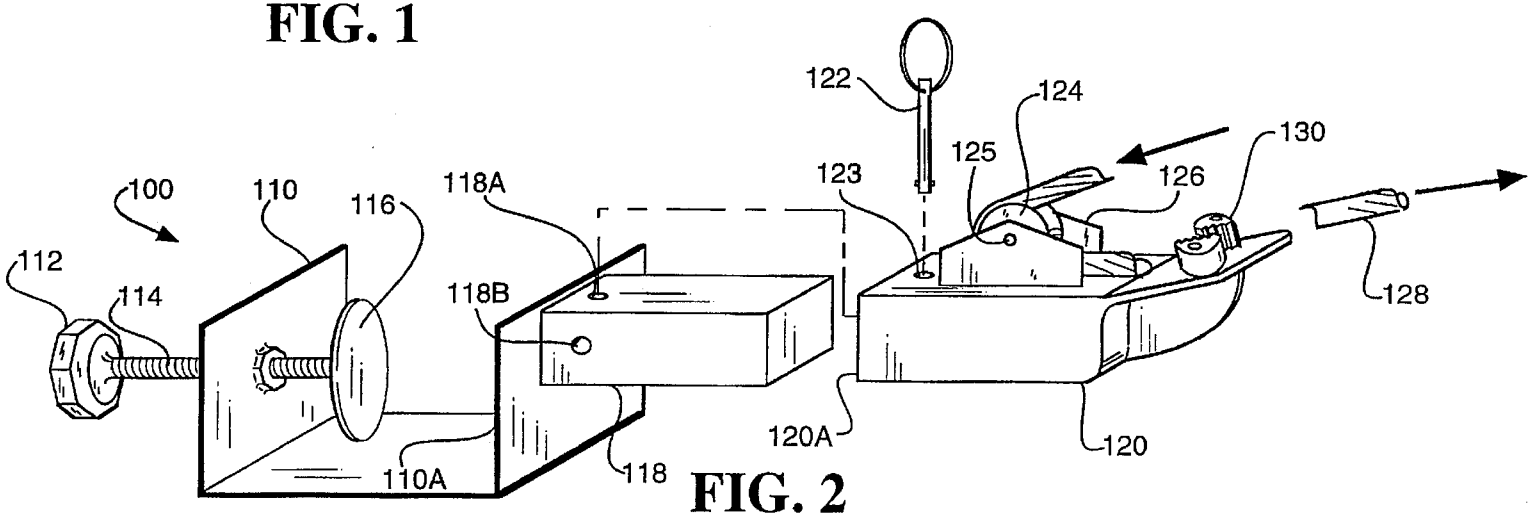
FIG. 2 depicts an embodiment of the present invention.

The connection between the anchor 110 and the support 120 is made by a protrusion 118 that extends outward with a first hole and a second hole therethrough, 118*a* and 118*b* respectively, which holes are angularly related as shown in FIG. 2. Specifically, these holes are orthogonally related to one another in this embodiment. The holes permit the support 120, by way of a recess 120*a*, to slip over the protrusion 118 and attach to the anchor 110 in any one of a plurality of orientations. At any of these orientations, the pin 122 can be inserted through one of the holes 118*a*, 118*b* to secure the anchor 110 to the support 120.

In the embodiment shown, the protrusion 118 has four sides and permits the support 120 to attach to the anchor bracket 110 in any one of four orientations. The support 120 has a recess 120*a* that is complementary to the protrusion 118. An orientation is shown in FIG. 2 where the bracket 110 is to be clamped to a horizontal fixture (e.g. door 300) such as that shown in FIG. 1. The support 120 is placed over the protrusion 118 and the pin 122 is placed into hole 118*a* to secure the mating.

The support 120 can also mate with the protrusion 118 in another orientation with the pin 122 placed through the hole 118*b*. This mating is beneficial for attaching the anchor to a vertical fixture, such as a post 302, as shown in FIG. 4. The device 100 can be clamped to any part of the post, but preferably a point close to the ground so that when the leg is stretched, an acute angle is formed between the line 128 and the ground.

FIG. 5 shows a stake 304 placed through the support 120 hole 123. This configuration permits the support 120 to be attached to a fixture such as the ground 306 using the stake 304 as an anchor. This embodiment permits the use of the invention outdoors, for instance. All the benefits described above are equally applicable to this example.

Having disclosed a preferred embodiment and the best mode, modifications and variations may be made to the disclosed embodiments while remaining within the scope of the present invention as defined by the claims.

What is claimed is:

1. In a stretching device for an appendage of a human user, which device is adapted for use by said user in a variety of orientations, the combination comprising:

A. a line having loop at first location on one side of a support to secure a human leg appendage to said line by way of a user's foot, and a second location on another side of said support having a handle for manipulation by a user while the user's appendage is secured at said first location;

B. a support having opposed ends and:

i. redirecting means adjacent one of said ends for redirecting said line from a first direction to a second direction; and ii. an anchor connector adjacent the end of said support opposite the end having said redirecting means, said anchor connector having adjacent the opposed end either a female cavity connector component or a male protrusion connector component having a plurality of male sides that mate with corresponding female sides within said cavity in any one of a plurality of different orientations of said connectors relative to one another;

C. an anchor for securing said support to a fixture, said anchor being configured to be easily separable by said human user from said support and having opposed ends and:

i. a clamp adjacent one of said ends for securance of said anchor to a fixture; and ii. a support connector adjacent said other opposed end, defining the one of said female and male components not defined by said anchor connector, said male and female components having holes extending therethrough which register when said sides of said components mate in any of said different orientations;

D. means extendable through registering holes in said components for securing said support and said anchor together at different relative orientations; and E. a grip positioned relative to said support to selectively prevent said line from moving lengthwise during said stretching toward said first location, said grip including a cam cleat having opposing spring loaded cams to engage said line and prevent its movement lengthwise toward said first location.

2. The combination of claim 1, wherein:

said support has a hole extending therethrough adapted to receive a stake.

3. In a stretching device for a leg hamstring muscle of a human user, which device is adapted for use by said user in a variety of orientations, the combination comprising:

A. a line having a loop at a first location one side of said support to secure a human leg appendage to said line by way of a user'foot, and a second location on another side of said support having a handle for manipulation by a user while the user's appendage is secured at said first location;

B. a support having:

i. a pulley for redirecting said line from a first direction to a second direction; and ii. an anchor connector adjacent the end of said support opposite the end having said pulley, said anchor connector having adjacent the opposed end either a female cavity connector component or a male protrusion connector component having a plurality of male sides that mate with corresponding female sides within said cavity in any one of a plurality of different orientations of said connectors relative to one another;

C. an anchor connectable to said support for securing said support to a fixture, said anchor being easily separable by said human user from said support and having:

i. a clamp adjacent one end for securance of said anchor to a fixture, said clamp including:

a. a bracket for placement about an edge of said fixture; and b. a plate for bearing against said fixture to capture said fixture edge; and ii. a support connector adjacent an end of said anchor opposite said end having said clamp, said support connector defining the one of said female and male components not defined by said anchor connector of said support, said male and female components having holes extending therethrough which register when said sides of said components mate in any of said different orientations;

D. a pin extendable through registering holes in said components for securing said support and said anchor together at a selected one of said different orientations; and E. a cam cleat having_opposed spring loaded, cams to engage said line and prevent its movement lengthwise toward said first location.

4. The combination of claim 3, wherein:

said protrusion is square and said female cavity is square, and said support is connectable to said anchor in any of four possible orientations.

* * * * *